US011545750B2

(12) United States Patent
Xi et al.

(10) Patent No.: US 11,545,750 B2
(45) Date of Patent: Jan. 3, 2023

(54) PHASE SHIFTER AND MANUFACTURING METHOD THEREOF, ANTENNA AND MANUFACTURING METHOD THEREOF

(71) Applicant: Shanghai Tianma Micro-Electronics Co., Ltd., Shanghai (CN)

(72) Inventors: Kerui Xi, Shanghai (CN); Xuhui Peng, Shanghai (CN); Feng Qin, Shanghai (CN); Tingting Cui, Shanghai (CN); Zhenyu Jia, Shanghai (CN); Ping Su, Shanghai (CN); Yuantao Wu, Shanghai (CN)

(73) Assignee: Shanghai Tianma Micro-Electronics Co., Ltd., Shanghai (CN)

( * ) Notice: Subject to any disclaimer, the term of this patent is extended or adjusted under 35 U.S.C. 154(b) by 13 days.

(21) Appl. No.: 16/999,781

(22) Filed: Aug. 21, 2020

(65) Prior Publication Data

US 2021/0408680 A1 Dec. 30, 2021

(30) Foreign Application Priority Data

Jun. 30, 2020 (CN) ..... 202010615238.0

(51) Int. Cl.
*H01Q 3/36* (2006.01)
*H01Q 3/26* (2006.01)

(52) U.S. Cl.
CPC ..... *H01Q 3/36* (2013.01); *H01Q 3/2676* (2013.01)

(58) Field of Classification Search
CPC ..... H01Q 1/364; H01Q 3/2676; H01Q 3/36; H01Q 3/44; H01Q 9/0407
See application file for complete search history.

(56) References Cited

U.S. PATENT DOCUMENTS 5,301,046 A * 4/1994 Konuma ..... G02F 1/1334 349/92
2017/0170557 A1* 6/2017 Shipton ..... C09K 19/18
(Continued)

FOREIGN PATENT DOCUMENTS

CN 205507315 U 8/2016
CN 108803096 A 11/2018
(Continued)

OTHER PUBLICATIONS

State Intellectual Property Office of the People's Republic of China, First Office Action, Chinese Patent Application No. 2020106152380, 20 pages.

*Primary Examiner* — Awat M Salih
(74) *Attorney, Agent, or Firm* — Christensen O'Connor Johnson Kindness PLLC

(57) ABSTRACT

A phase shifter and a manufacturing method thereof and an antenna and a manufacturing method thereof are provided. The phase shifter includes: first and second substrates opposite to each other; a first electrode provided on the first substrate and configured to receive a ground signal; a second electrode provided on a side of the second substrate facing towards the first substrate; liquid crystals encapsulated between the first substrate and the second substrate and driven by the first electrode and the second electrode to rotate; and a support structure provided between the first substrate and the second substrate and including a first spacer. The first spacer is located on a side of the second electrode facing away from the second substrate, and an orthographic projection of the first spacer on the second substrate is within an orthographic projection of the second electrode on the second substrate.

20 Claims, 10 Drawing Sheets

(56) References Cited

U.S. PATENT DOCUMENTS

| | | | | |
|---|---|---|---|---|
| 2018/0375200 | A1* | 12/2018 | Li | H01Q 1/36 |
| 2019/0103671 | A1* | 4/2019 | Dong | H01Q 9/0407 |
| 2019/0146248 | A1* | 5/2019 | Wang | H01Q 1/364 349/1 |
| 2019/0204708 | A1* | 7/2019 | Wang | G02F 1/133512 |
| 2019/0237849 | A1* | 8/2019 | Misaki | H01L 27/1218 |
| 2020/0044307 | A1* | 2/2020 | Hirai | H01Q 1/2283 |
| 2020/0343635 | A1* | 10/2020 | Hu | H01P 1/184 |
| 2021/0088837 | A1* | 3/2021 | Li | G02F 1/133512 |
| 2021/0208430 | A1* | 7/2021 | Liu | H01Q 1/38 |
| 2021/0208472 | A1* | 7/2021 | Liu | G02F 1/1339 |
| 2022/0121055 | A1* | 4/2022 | Yu | G02F 1/1337 |

FOREIGN PATENT DOCUMENTS

| | | | |
|---|---|---|---|
| CN | 109690870 | A | 4/2019 |
| CN | 109782494 | A | 5/2019 |
| CN | 110320713 | A | 10/2019 |

* cited by examiner

PHASE SHIFTER AND MANUFACTURING METHOD THEREOF, ANTENNA AND MANUFACTURING METHOD THEREOF

CROSS-REFERENCE TO RELATED APPLICATIONS

The present application claims priority to Chinese Patent Application No. 202010615238.0, filed on Jun. 30, 2020, the content of which is in incorporated herein by reference in its entirety.

TECHNICAL FIELD

The present disclosure relates to the field of electromagnetic wave technology, in particular to a phase shifter and a manufacturing method thereof, and an antenna and a manufacturing method thereof.

BACKGROUND

With the evolution of communication systems, phase shifters are more and more widely used. Taking a liquid crystal phase shifter as an example, the liquid crystal phase shifter controls the rotation of the liquid crystal to change the dielectric constant of the liquid crystal, in such a manner that phase of the radio frequency signal transmitted in the liquid crystal phase shifter is shifted.

SUMMARY

In view of the above, the present disclosure provides a phase shifter and a manufacturing method thereof, and an antenna and a manufacturing method thereof.

An embodiment of the present disclosure provides a phase shifter. The phase shifter includes: a first substrate and a second substrate that are opposite to each other; a first electrode provided on the first substrate and configured to receive a ground signal; a second electrode provided on a side of the second substrate facing towards the first substrate; liquid crystals encapsulated between the first substrate and the second substrate and configured to rotate under driving by the first electrode and the second electrode; and a support structure provided between the first substrate and the second substrate and including at least one first spacer, wherein the at least one first spacer is located on a side of the second electrode facing away from the second substrate, and an orthographic projection of each of the at least one first spacer on the second substrate is within an orthographic projection of the second electrode on the second substrate.

An embodiment of the present disclosure provides a method for manufacturing a phase shifter. The method includes: providing a first substrate and forming a first electrode on the first substrate, the first electrode being configured to receive a ground signal; providing a second substrate and forming a second electrode on the second substrate; forming a first spacer on the first substrate or the second substrate; and oppositely arranging the first substrate and the second substrate to form a cell in such a manner that in a direction perpendicular to a plane of the second substrate, an orthographic projection of the first spacer is within an orthographic projection of the second electrode.

An embodiment of the present disclosure provides an antenna. The antenna includes: the above-described phase shifter; a feeder portion provided on the first substrate and configured to receive radio frequency signals; and a radiator arranged on the first substrate and configured to radiate phase-shifted radio frequency signals.

An embodiment of the present disclosure provides a method for manufacturing an antenna. The method includes: forming the above-described phase shifter; and forming a feeder portion and a radiator on the first substrate, the feeder portion being configured to receive radio frequency signals and the radiator being configured to radiate phase-shifted radio frequency signals.

BRIEF DESCRIPTION OF DRAWINGS

In order to better explain the technical solutions of embodiments of the present disclosure, the accompanying drawings used in the embodiments are introduced as follows. The drawings described as follows are merely part of the embodiments of the present disclosure, and other drawings can also be acquired according to the drawings by those skilled in the art.

DESCRIPTION OF EMBODIMENTS

For better understanding the technical solutions of the present disclosure, the embodiments of the present disclosure are described in detail below with reference to the accompanying drawings.

It should be noted that the described embodiments are merely some embodiments of the present disclosure, but not all of the embodiments. Other embodiments obtained by those skilled in the art based on the embodiments of the present disclosure are within the protection scope of the present disclosure.

The terms used in the embodiments of the present disclosure are merely for the purpose of describing particular embodiments and not intended to limit the present disclosure. Unless otherwise noted in the context, the singular form expressions "a", "an", "the" and "said" used in the embodiments and appended claims of the present disclosure are also intended to represent a plural form.

It should be understood that the term "and/or" as used herein merely indicates an association relationship to describe the associated object, meaning that there can be three relationships, for example, A and/or B can indicate three cases: A exists individually; A and B exist simultaneously; B exists individually. In addition, the character "/" as used herein generally indicates that the contextual associated objects are in an "or" relationship.

It should be understood that, in the embodiments of the present disclosure, although the terms first, second, third, etc. can be used to describe the substrate, the electrode, and the spacer, they should not be limited to these terms. These terms are only used to distinguish the substrates, the electrodes and the spacers from each other. For example, without departing from the scope of the embodiments of the present disclosure, the first substrate can also be referred to as a second substrate and, similarly, and the second substrate can also be referred to as a first substrate.

Figure 1:
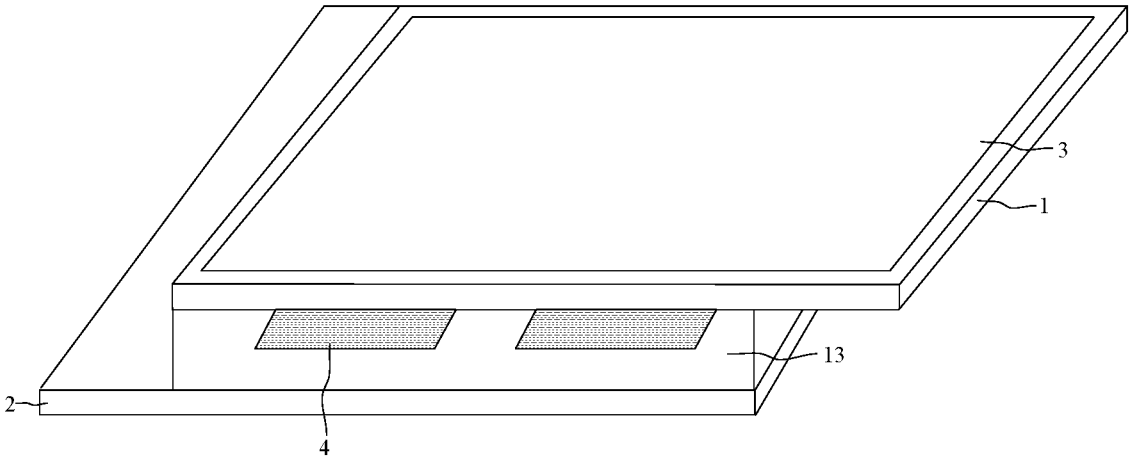
FIG. 1 is a schematic diagram of a phase shifter provided by an embodiment of the present disclosure.
Figure 2:
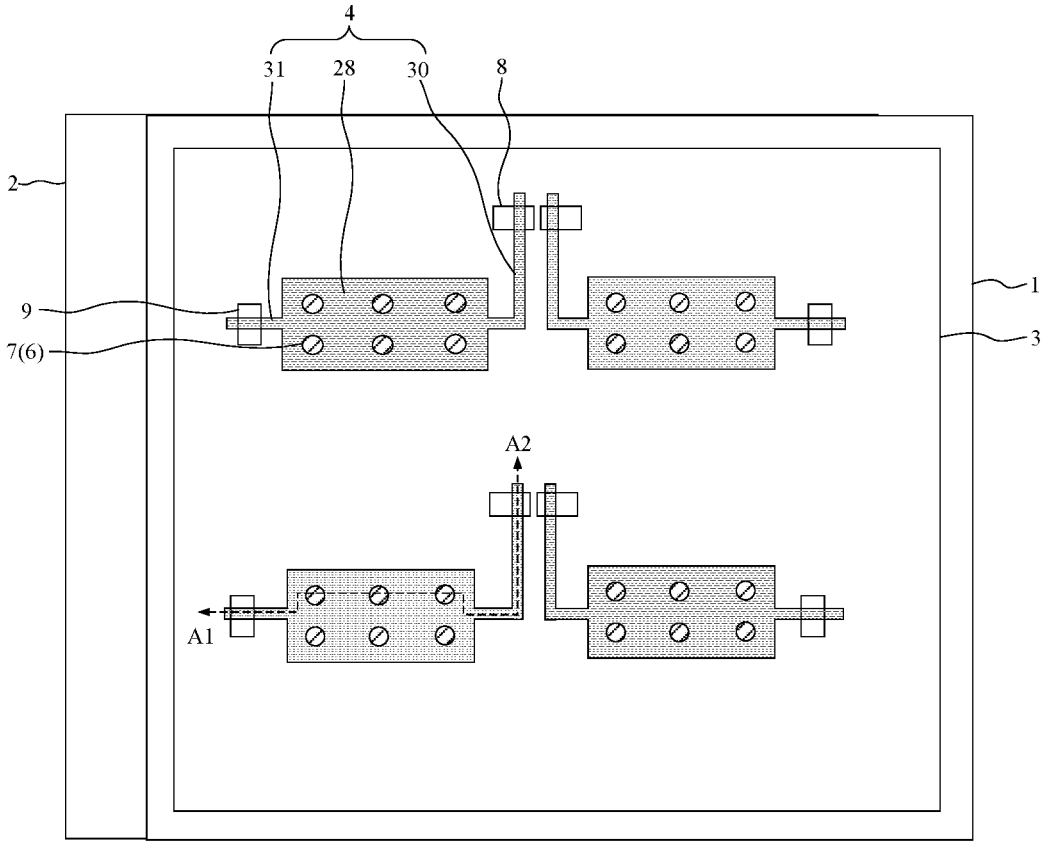
FIG. 2 is a top view of a phase shifter provided by an embodiment of the present disclosure.
Figure 3:
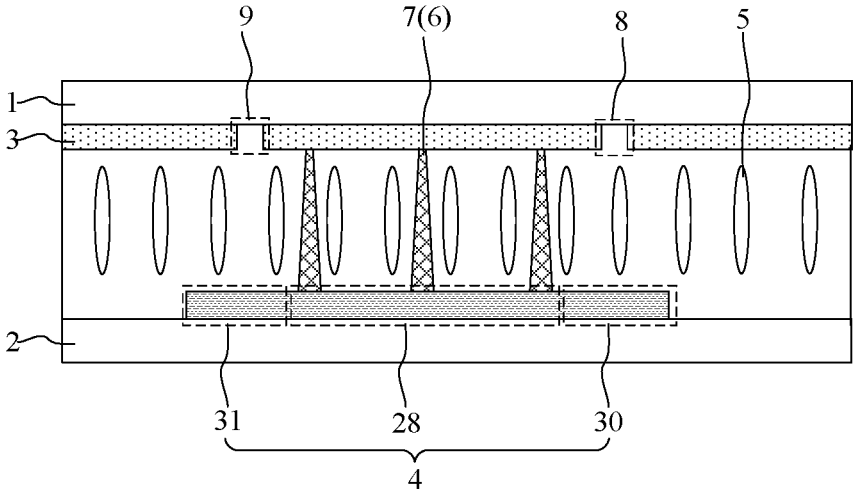
FIG. 3 is a cross-sectional view along line A1-A2 shown in FIG. 2.

An embodiment of the present disclosure provides a phase shifter. FIG. 1 is a schematic diagram of a phase shifter according to an embodiment of the present disclosure, and FIG. 2 is a top view of a phase shifter according to an embodiment of the present disclosure, and FIG. 3 is a cross-sectional view along line A1-A2 shown in FIG. 2. As shown in FIG. 1 to FIG. 3, the phase shifter includes a first substrate 1 and a second substrate 2 that are arranged opposite to each other, liquid crystals 5, and a supporting structure 6. A first electrode 3 is provided on the first substrate 1 and is configured to receive a ground signal. A second electrode 4 is provided on a side of the second substrate 2 facing towards the first substrate 1. The liquid crystal 5 is encapsulated between the first substrate 1 and the second substrate 2, and the first electrode 3 and the second electrode 4 drive the liquid crystals 5 to rotate. The supporting structure 6 is provided between the first substrate 1 and the second substrate 2. The supporting structure 6 includes a first spacer 7 located on a side of the second electrode 4 facing away from the second substrate 2. An orthographic projection of the first spacer 7 on the second substrate 2 is within an orthographic projection of the second electrode 4 on the second substrate 2.

Figure 4:
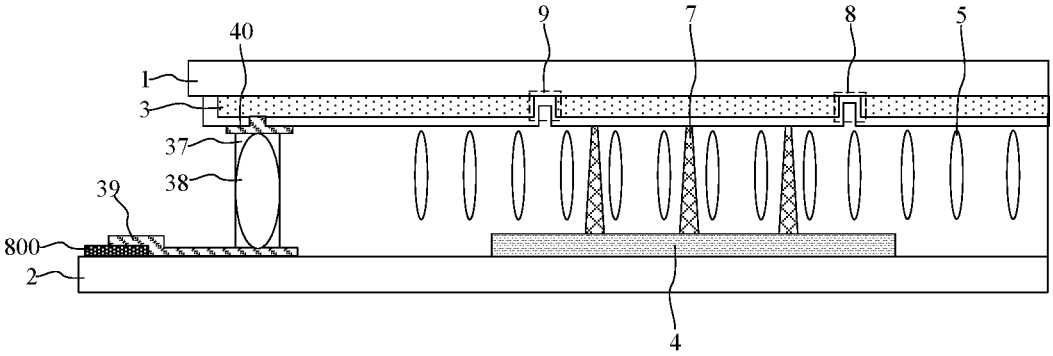
FIG. 4 is a schematic diagram showing connection of a first electrode provided by the embodiment of the present disclosure.

In an embodiment, the first electrode 3 can be electrically connected to a ground terminal of a flexible circuit board or a ground signal source, and is configured to receive a ground signal from the flexible circuit board or a ground signal from the ground signal source. For example, when the first electrode 3 is electrically connected to the ground terminal of the flexible circuit board, as shown in FIG. 4 which is a schematic diagram showing connection of the first electrode provided by the embodiment of the present disclosure, a conductive gold ball 38 is arranged in the sealant 37 that is close to a bonding position of the flexible circuit board. One end of the conductive gold ball 38 is electrically connected to the ground terminal 800 of the flexible circuit board (not shown in the figure) through a first connecting wire 39, and another end of the conductive gold ball 38 is electrically connected to the second electrode 3 through a second connecting wire 40, so that the ground signal from the flexible circuit board is transmitted to the first electrode 3.

The second electrode 4 can adopt an active driving mode or a passive driving mode. In an embodiment, the second electrode 4 adopts the active driving mode, for example, a plurality of scanning lines and a plurality of data lines are provided on the second substrate 2 by intersecting with each other while being mutually electrically isolated. The scanning line is configured to receive a scanning signal from a driver chip, the flexible circuit board or a printed circuit board. The data line is configured to receive a data signal from the driver chip, the flexible circuit board or the printed circuit board. The second substrate 2 is also provided with a plurality of transistors corresponding to a plurality of second electrodes 4 in a one-to-one correspondence. A gate of the transistor is electrically connected to the scanning line, the source is electrically connected to the data line, and the drain is electrically connected to the second electrode 4. The transistor is driven to be turned on under the scanning signal, and thus the data signal is transmitted to the second electrode 4 which is electrically connected to the transistor. In an embodiment, the second electrode 4 adopts the passive driving mode, for example, the second electrode 4 can be electrically connected to a driving terminal of the flexible circuit board and is configured to receive the driving signal from the flexible circuit board.

Figure 18:
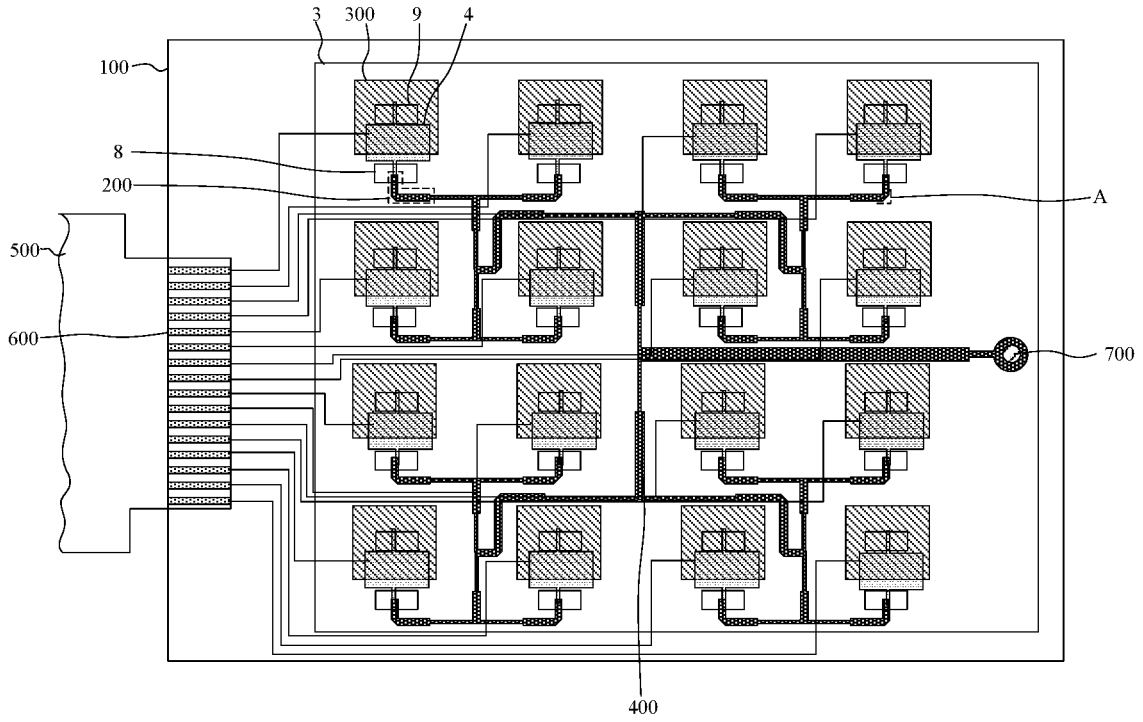
FIG. 18 is a top view of an antenna provided by an embodiment of the present disclosure.
Figure 19:
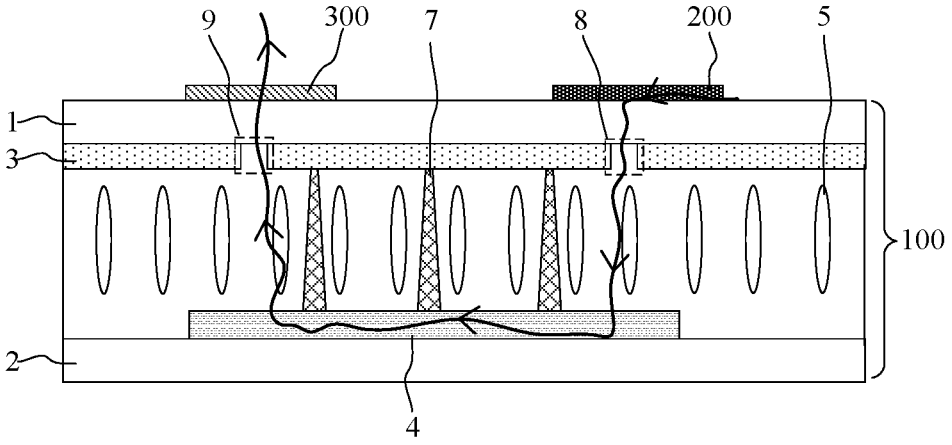
FIG. 19 is a partial cross-sectional view of an antenna provided by an embodiment of the present disclosure.

With reference to FIG. 3, FIG. 18 and FIG. 19, the first electrode 3 is provided with a first opening 8 and a second opening 9 that are configured to couple a radio frequency signal, and a feeder portion 200 and a radiator 300 are provided on a side of the first substrate 1 facing away from the second substrate 2, and the feeder portion 200 is electrically connected to a power division network 400 and configured to receive radio frequency signals transmitted from the power division network 400. When the phase shifter performs a phase shift on the radio frequency signal, the radio frequency signal transmitted in the feeder portion 200 is coupled to the second electrode 4 through the first opening 8 of the first electrode 3. Furthermore, the liquid crystals 5 are driven to rotate by an electric field formed between the first electrode 3 and the second electrode 4 to change the dielectric constant of the liquid crystals 5, so that phase of the radio frequency signal transmitted in the second electrode 4 is shifted. The phase-shifted radio frequency signal is coupled to the radiator 300 through the second opening 9 of the first electrode 3 and is radiated through the radiator 300 (the transmission path of the radio frequency signal is shown by the arrow in FIG. 19).

In view of the above principles, it can be seen that a region where the second electrode 4 is located is a key region where the phase shifter performs the phase-shift on the radio frequency signal. In an embodiment of the present disclosure, the first spacer 7 is arranged on the second electrode 4, and the first spacer 7 can stably support the cell gap located in the region where the second electrode 4 is located, which can effectively improve the uniformity of the cell gap located in the region where the second electrode 4 is located, reduce the difference between the filling volumes of the liquid crystal 5 located in different regions, and optimize the phase shift effect of radio frequency signal. Even when the phase shifter is compressed caused by factors such as an external extrusion force or being in a low temperature environment, the compression degree at this region can be significantly reduced due to support of the first spacer 7, thereby avoiding significant difference of the cell gap in this region.

It can be seen that the phase shifter provided by the present disclosure can effectively improve the uniformity of the cell gap located in the key region where the phase shifter performs the phase shift on the radio frequency signal, which can effectively increase the accuracy of the radiation angle of the radio frequency signal radiated by the phase shifter, thereby increasing the gain of the antenna.

In an embodiment, the first spacer 7 can be made of an inorganic material such as silicon nitride or silicon dioxide. Compared with organic materials such as resin, the loss of radio frequency signals when passing through inorganic materials is smaller. Therefore, the first spacer 7 is made of the inorganic materials. Even if the radio frequency signal passes through the first spacer 7, the loss is small, which avoids significantly affecting the strength of the final radiated signal.

In an embodiment, referring to FIG. 2 and FIG. 3, the first electrode 3 is provided with the first opening 8 and the second opening 9 that are configured to couple radio frequency signals. In combination with the above, the first opening 8 is configured to couple the radio frequency signal transmitted in the feeder portion 200 to the second electrode 4. The second opening 9 is configured to couple the radio frequency signal transmitted in the second electrode 4 to the radiator 300. In a direction perpendicular to a plane of the first substrate 1, the orthographic projection of the spacer 7 does not overlap with the first opening 8 or the second opening 9, so as to prevent the first spacer 7 from blocking the first opening 8 and the second opening 9 and thus not affecting the coupling of radio frequency signals, thereby improving the stability of the transmission of the radio frequency signals.

Figure 5:
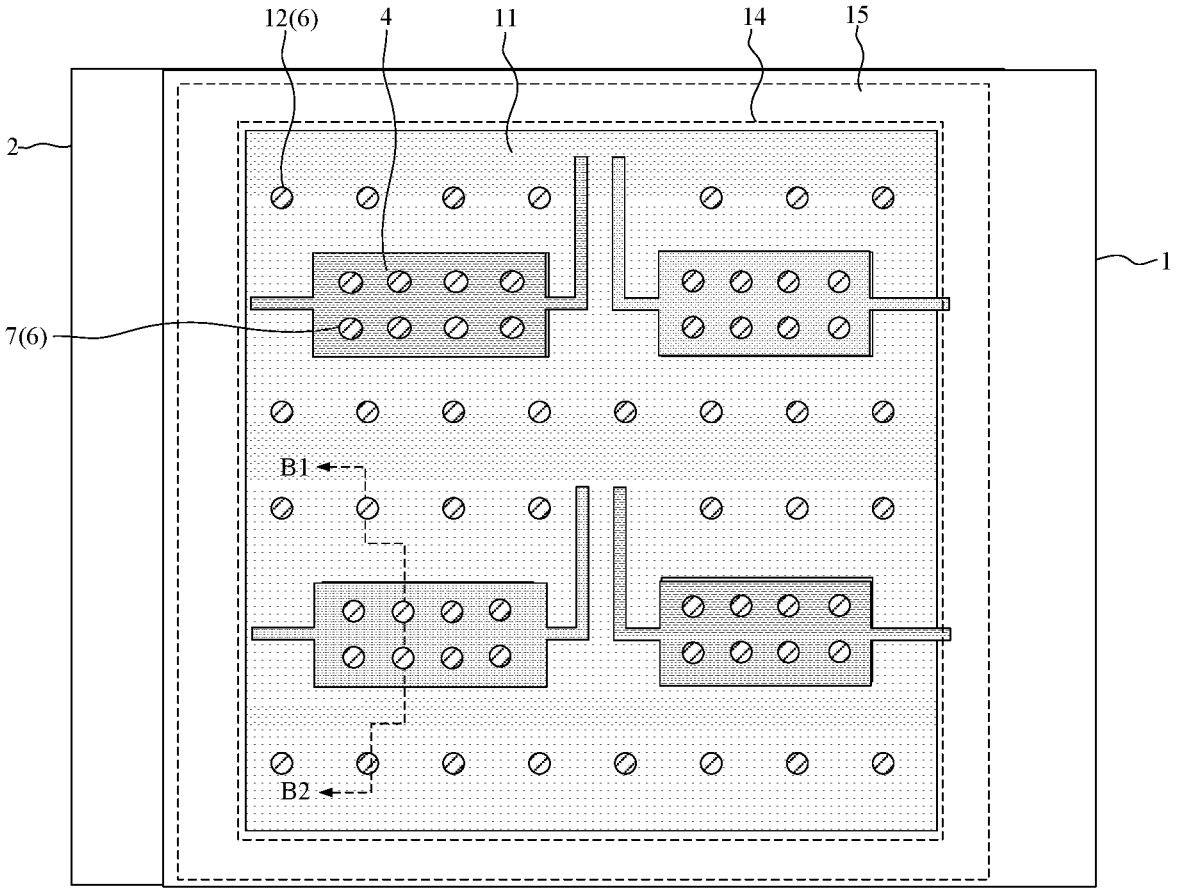
FIG. 5 is a schematic diagram of an arrangement of an elevating layer provided by an embodiment of the present disclosure.
Figure 6:
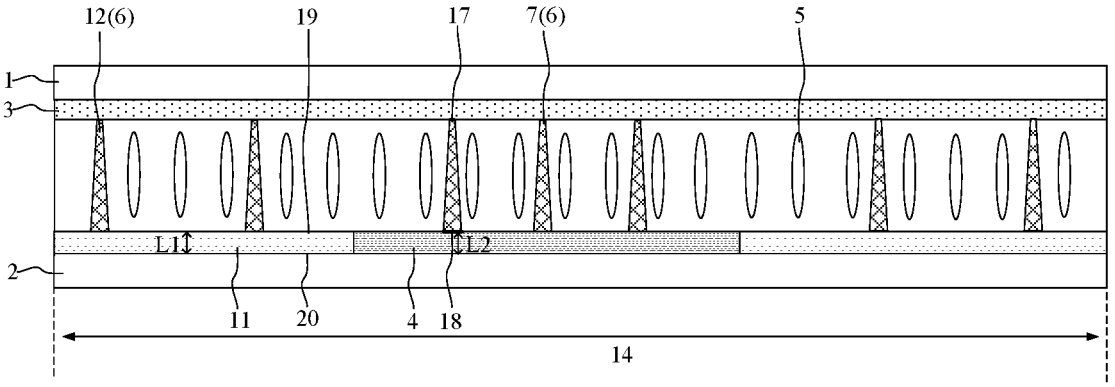
FIG. 6 is a cross-sectional view along line B1-B2 shown in FIG. 5.

FIG. 5 is a schematic diagram of an arrangement of an elevating layer provided by an embodiment of the present disclosure, and FIG. 6 is a cross-sectional view along a line B1-B2 shown in FIG. 5. In an embodiment, as shown in FIG. 5 and FIG. 6, an elevating layer 11 is provided on a side of the second substrate 2 facing towards the first substrate 1, and in the direction perpendicular to a plane of the second substrate 2, an orthographic projection of the elevating layer 11 and the orthographic projection of the second electrode 4 do not overlap with each other. The supporting structure 6 further includes a second spacer 12 arranged on a side of the elevating layer 11 facing away from the second substrate 2. In the direction perpendicular to the plane of the second substrate 2, an orthographic projection of the second spacer 12 is within the orthographic projection of the elevating layer 11.

It should be noted that although the region where the second electrode 4 is located is the key region where the phase shift is performed on the radio frequency signal in the phase shifter, the liquid crystals 5 located in a peripheral region surrounding the second electrode 4 will also play a certain role in phase-shifting the radio frequency signals. Therefore, the elevating layer 11 and the second spacer 12 are provided outside the second electrode 4, so that the elevating layer 11 can elevate the second spacer 12 and thus the height of the elevated second spacer 12 is approaching the height of the first spacer 7 arranged on the second electrode 4. In this way, the second spacer 12 can also stably support the peripheral region surrounding the second electrode 4, which improves the uniformity of the cell gap of the entire region of the phase shifter.

In an embodiment, referring to FIG. 1, FIG. 5 and FIG. 6, a directly facing cavity 13 is formed between the first substrate 1 and the second substrate 2. The directly facing cavity 13 includes a phase shift region 14 and an encapsulation region 15 surrounding the phase shift region 14. In the direction perpendicular to the plane of the second substrate 2, the orthographic projection of the elevating layer 11 and the orthographic projection of the second electrode 4 cover the entirety of the phase shift region 14, and a surface of the elevating layer 11 facing away from the second substrate 2 is a flat surface. With such configuration, no matter where the second spacer 12 is arranged in the phase shift region 14, the second spacer 12 can be elevated by the elevating layer 11, which improves the flexibility regarding the selection of the position where the second spacer 12 is arranged, as well as the support reliability of the second spacer 12.

Figure 7:
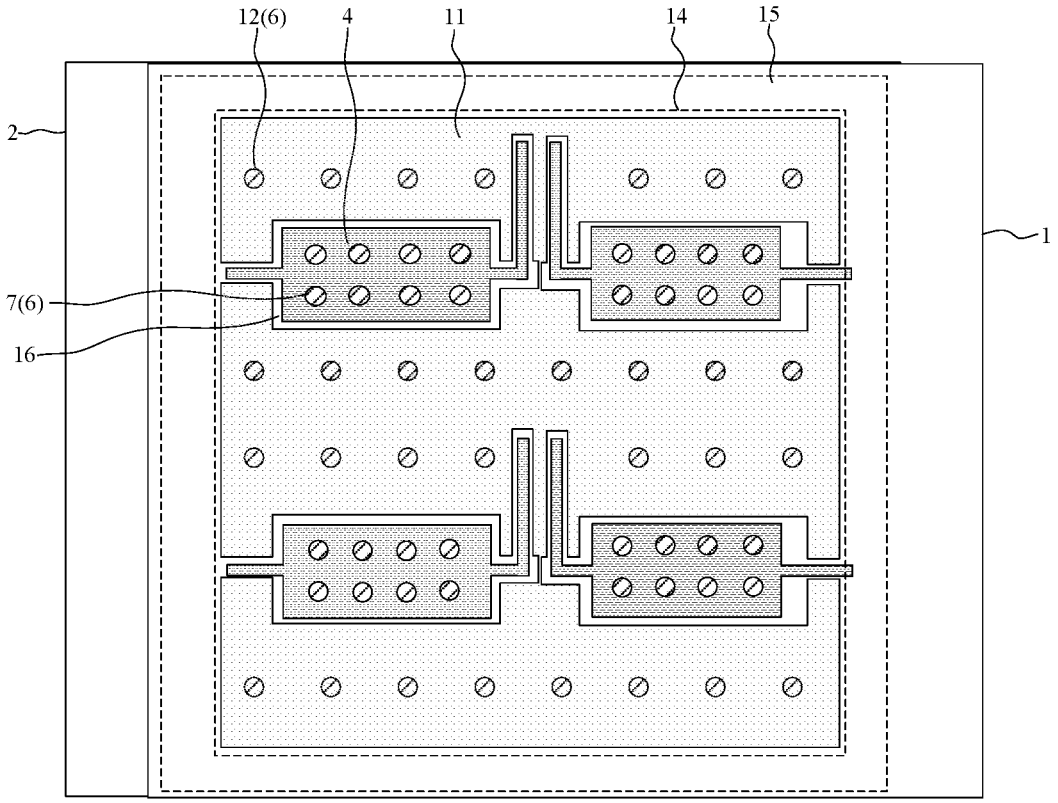
FIG. 7 is a schematic diagram of an arrangement of an elevating layer provided by another embodiment of the present disclosure.

In an embodiment, in the manufacturing process of the elevating layer 11, taking the influence of factors such as process accuracy into account, in order to avoid the loss of radio frequency signals caused by the elevating layer 11 formed after etching from covering the surface of the second electrode 4, another embodiment of the present disclosure provides an arrangement of the elevating layer, as shown in FIG. 7. When etching the elevating material used to make the elevating layer 11, an over-etching can be performed on the periphery of the elevating material surrounding the second electrode 4, to form a gap 16 between the elevating layer 11 and an edge of the second electrode 4, thereby avoid leaving insufficiently etched elevating material on the surface of the second electrode 4.

In an embodiment, referring to FIG. 6, the first spacer 7 includes a first top surface 17 and a first bottom surface 18 that are opposite to each other, and the elevating layer 11 includes a second top surface 19 and a second bottom surface 20 that are opposite to each other. Each one of the first bottom surface 18 and the second bottom surface 20 is a surface close to the second substrate 2. A distance between the second top surface 19 and the second substrate 2 is L1, and a distance between the first bottom surface 18 and the second substrate 2 is L2. L1 is equal to L2, which ensures that the height of the elevating layer 11 is equal to the distance between the first bottom surface 18 of the first spacer 7 and the second substrate 2. In this way, the height of the second spacer 12 after being elevated is equal to the height of the first spacer 7. After the first substrate 1 and the second substrate 2 are oppositely arranged to form a cell, the second spacer 12 can stably support the cell gap located in the peripheral region surrounding the second electrode 4.

Figure 8:
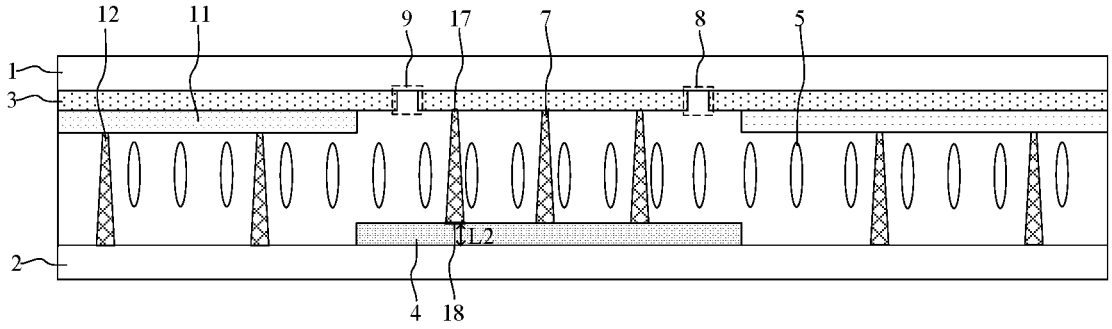
FIG. 8 is a cross-sectional view along line B1-B2 shown in FIG. 5 provided by another embodiment of the present disclosure.

FIG. 8 is a cross-sectional view along the line B1-B2 shown in FIG. 5 provided by another embodiment of the present disclosure. In an embodiment, as shown in FIG. 8, the elevating layer 11 can be disposed on the first substrate 1 and located on a side of the first electrode 3 facing towards the second substrate 2, and in order to ensure the stable support of the second spacer 12, a thickness of the elevating layer 11 can be equal to the distance between the first bottom surface 18 of the first spacer 7 and the second substrate 2.

In an embodiment, the elevating layer 11 is made of an optical adhesive material. In this way, in the manufacturing process of forming the elevating layer 11, optical adhesive is in a liquid state during coating, so that the coating efficiency is high, and the leveling property is good. The formed elevating layer 11 has a flatter surface, thereby reducing the difference in height of the second spacers 12 that are elevated in different regions.

In an embodiment, in order to enhance the support strength of the elevating layer 11 to the second spacer 12, the elevating layer 11 can be made of a same material as the material of the second spacer 12.

In an embodiment, referring to FIG. 5 and FIG. 6, in a unit area, a distribution density of the first spacers 7 is greater than a distribution density of the second spacers 12, so that the first spacers 7 can stably support the cell gap located in the region where the second electrode 4 is located, thereby greatly improving the uniformity of the cell gap located in the phase-shift key region. In an embodiment, in order to improve the uniformity of the cell gap located at different positions of the key region, the first spacers 7 can be evenly arranged on the second electrode 4 at equal intervals.

Figure 9:
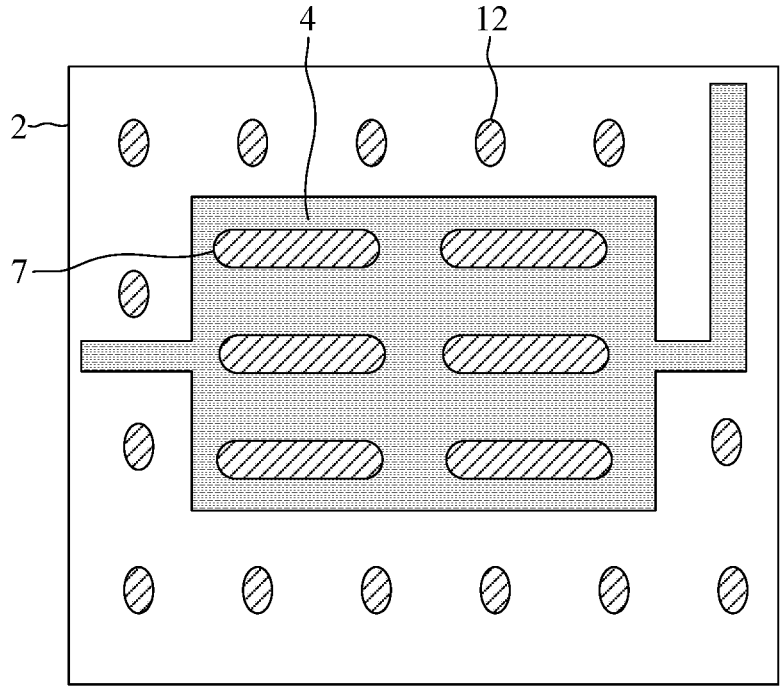
FIG. 9 is a schematic diagram of a first spacer provided by an embodiment of the present disclosure.

FIG. 9 is a schematic diagram of a first spacer provided by an embodiment of the present disclosure. In an embodiment, as shown in FIG. 9, an area of an orthographic projection of a single first spacer 7 on the second substrate 2 is greater than an area of an orthographic projection of a single second spacer 12 on the second substrate 2, to increase an overlapping area between the single first spacer 7 and one of the first substrate 1 and the second substrate 2, which enhances the support strength of the first spacer 7, thereby increasing support stability of the first spacer 7 to the region where the second electrode 4 is located.

When the area of the orthographic projection of the single first spacer 7 is greater than the area of the orthographic projection of the single second spacer 12, the first spacer 7 can have a structure having a shape different from the second spacer 12, but having a larger supporting area, or the first spacer 7 can have a structure having a shape same as the second spacer 12, but having a larger supporting area.

Figure 10:
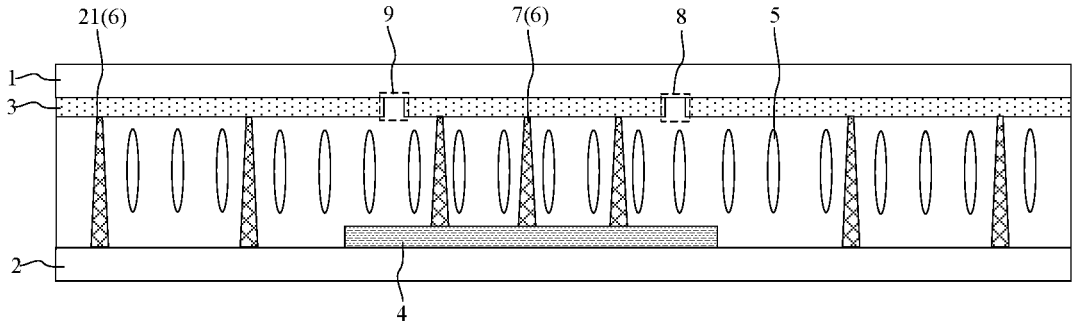
FIG. 10 is a schematic diagram of a third spacer provided by an embodiment of the present disclosure.

FIG. 10 is a schematic diagram of a third spacer provided by an embodiment of the present disclosure. In an embodiment, as shown in FIG. 10, the supporting structure 6 further includes a third spacer 21. In the direction perpendicular to the plane of the second substrate 2, an orthographic projection of the third spacer 21 and the orthographic projection of the second electrode 4 do not overlap with each other, and a height of the third spacer 21 is greater than the height of the first spacer 7. With such configuration, the third spacer 21 having a larger height and the first spacer 7 having a smaller height are directly formed through a halftone mask, so that the third spacer 21 having the larger height stably supports the peripheral region surrounding the second electrode 4, and there is no need to provide the elevating layer 11, which simplifies the process flow.

Figure 11:
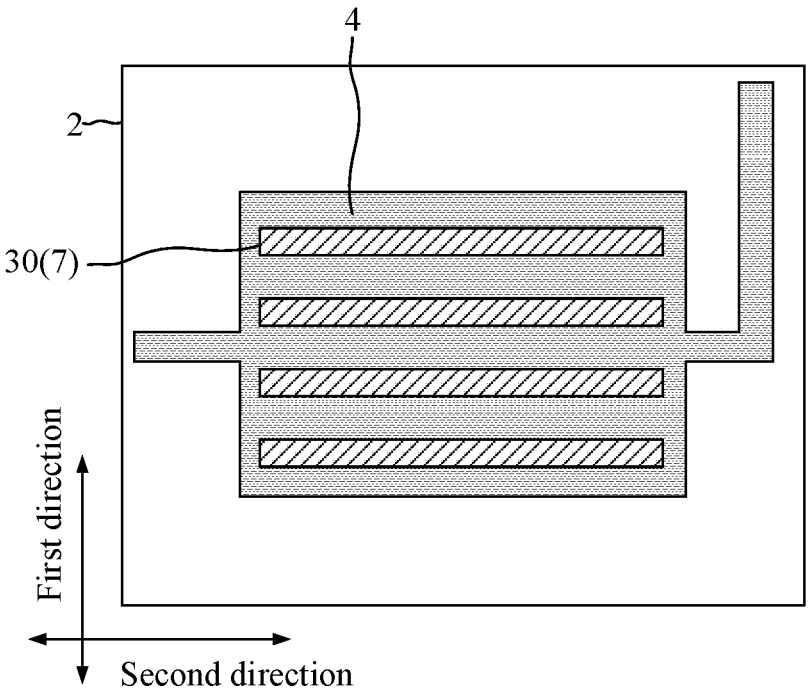
FIG. 11 is a schematic diagram of a first spacer provided by another embodiment of the present disclosure.

FIG. 11 is a schematic diagram of a first spacer provided by another embodiment of the present disclosure. In an embodiment, in order to increase the overlapping area between the first spacer 7 and the first substrate 1 and the overlapping area between the first spacer 7 and the second substrate 2, and to improve the support stability of the first spacer 7, as shown in FIG. 11, the first spacers 7 include multiple first sub-spacers 30 arranged along a first direction, and each first sub-spacer 30 extends along a second direction. The first direction and the second direction intersect with each other.

Figure 12:
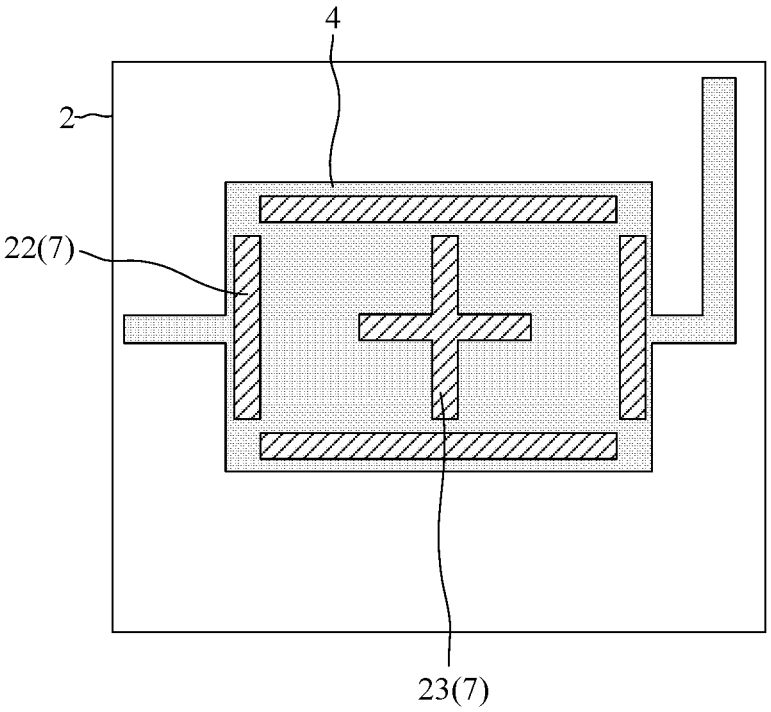
FIG. 12 is a schematic diagram of a first spacer provided by still another embodiment of the present disclosure.

FIG. 12 is a schematic diagram of the first spacer provided by another embodiment of the present disclosure. In an embodiment, as shown in FIG. 12, the first spacers 7 include a center spacer 23 and edge spacers 22 surrounding the central spacer 23, so that both an edge region and a central region of the second electrode 4 are effectively supported.

Figure 13:
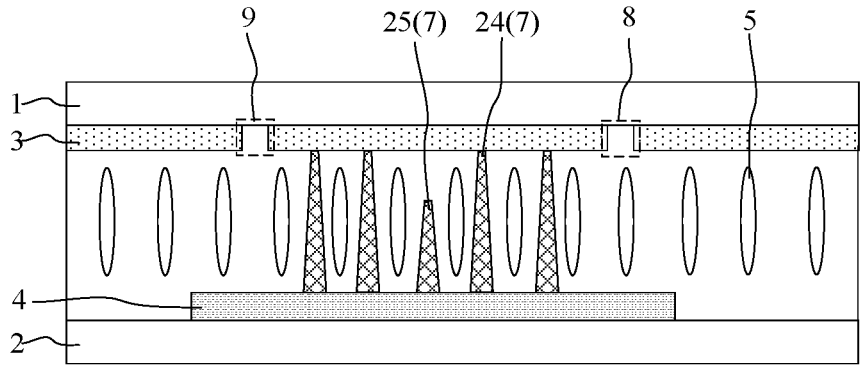
FIG. 13 is a schematic diagram of a first spacer provided by yet still another embodiment of the present disclosure.

FIG. 13 is a schematic diagram of the first spacer provided by another embodiment of the present disclosure. In an embodiment, as shown in FIG. 13, the first spacers 7 include a primary spacer 24 and an auxiliary spacer 25. In the direction perpendicular to the plane of the second substrate 2, a height of the primary spacer 24 is greater than a height of the auxiliary spacer 25. With such configuration, after the first substrate 1 and the second substrate 2 are oppositely arranged to form a cell, the primary spacer 24 having a larger height is used to support the cell gap. When the phase shifter is compressed due to an external extrusion force or the low temperature, the auxiliary spacer 25 having the smaller height provides an auxiliary support to the cell gap.

In an embodiment, with reference to the FIG. 13, in order to achieve a better uniformity of the cell gap in the key region of the phase shifter after the first substrate 1 and the second substrate 2 are oppositely arranged to form a cell, the primary spacers 24 are evenly arranged at equal intervals.

In an embodiment, in the direction perpendicular to the plane of the second substrate 2, multiple first spacers 7 have a same height.

Figure 14:
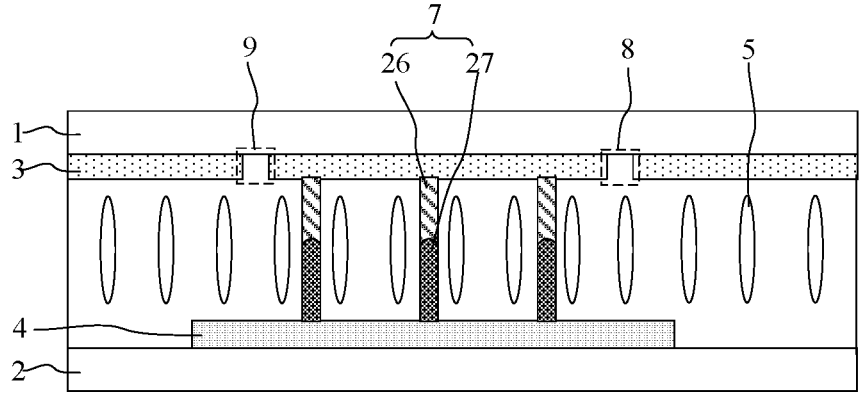
FIG. 14 is a schematic diagram of a first spacer provided by yet still another embodiment of the present disclosure.

FIG. 14 is a schematic diagram of a first spacer provided by another embodiment of the present disclosure. In an embodiment, as shown in FIG. 14, the first spacer 7 includes a first support part 26 and a second support part 27. The first support part 26 is provided on the first substrate 1, and the second support part 27 is provided on the second substrate 2. In the direction perpendicular to the plane of the second substrate 2, the first support part 26 and the second support part 27 overlap with each other. A single first spacer 7 includes two parts, i.e., the first support part 26 and the second support part 27, which is more conducive to realization of a big cell gap design. In other words, when the phase shifter adopts the big cell gap design, the spacer of the phase shifter also needs to have a large height, which is not easy to implement based on the conventional technology. With the above structure, a spacer is divided into two support parts, and thus neither of the two support parts needs to be set too high, which can make the overall spacer have a large height and reduce the processing difficulty of the first spacer 7.

In an embodiment, referring to FIG. 2 and FIG. 3, the first electrode 3 is provided with the openings for coupling radio frequency signals, and the second electrode 4 includes a primary electrode 28, a first coupling electrode 30, and a second coupling electrode 31 that are connected to each other. In the direction perpendicular to the plane of the first substrate 1, an orthographic projection of the first coupling electrode 30 and the first opening 8 overlap with each other, and an orthographic projection of the second coupling electrode 31 and the second opening 9 overlap with each other. In an embodiment, the primary electrode 28 is a strip-shaped electrode to have a larger electrode area, which can improve the uniformity of the electric field formed between the primary electrode 28 and the first electrode 3. In an embodiment, the second electrode 4 is a serpentine electrode or a comb-shaped electrode, which can lengthen a transmission path of the radio frequency signal in the primary electrode 28 and make the phase shift to be performed more sufficiently.

Figure 15:
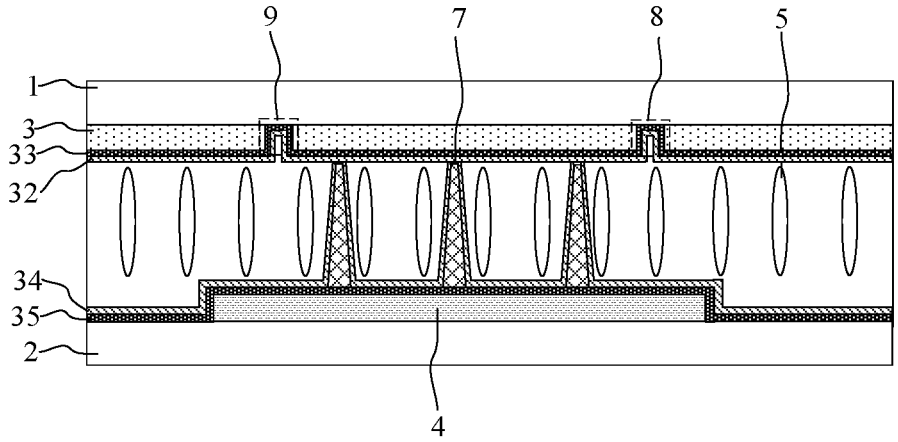
FIG. 15 is a schematic diagram of an inorganic protective layer provided by an embodiment of the present disclosure.

FIG. 15 is a schematic diagram of an inorganic protective layer provided by an embodiment of the present disclosure. In an embodiment, as shown in FIG. 15, in order to ensure the normal rotation of the liquid crystals 5, an alignment layer 32 is provided on a side of the first electrode 3 facing towards the second substrate 2, and a second alignment layer 34 is provided on a side of the second electrode 4 facing towards the first substrate 1. In an embodiment, a first inorganic protective layer 33 is provided between the first alignment layer 32 and the first electrode 3, and a second inorganic protective layer 35 is provided between the second electrode 4 and the second alignment layer 34.

The first inorganic protective layer 33 is provided between the first alignment layer 32 and the first electrode 3, and the second inorganic protective layer 35 is provided between the second alignment layer 34 and the second electrode 4, which can prevent particles of the alignment layer from diffusing into the copper metal of the first electrode 3 and the second electrode 4 and avoid affecting the performance of the first electrode 3 and the second electrode 4. Moreover, the protective layers are formed of the inorganic material, which can avoid loss of radio frequency signals.

Taking the first spacer 7 being disposed on the second substrate 2 as an example, referring to FIG. 15, in order to improve the alignment effect of the second alignment layer 34 on the liquid crystals 5, the second alignment layer 34 is disposed on a side of the first spacer 7 facing away from the second substrate 2, that is, during the manufacturing process, the first spacer 7 is formed first, and then the second alignment layer 34 is formed.

Figure 16:
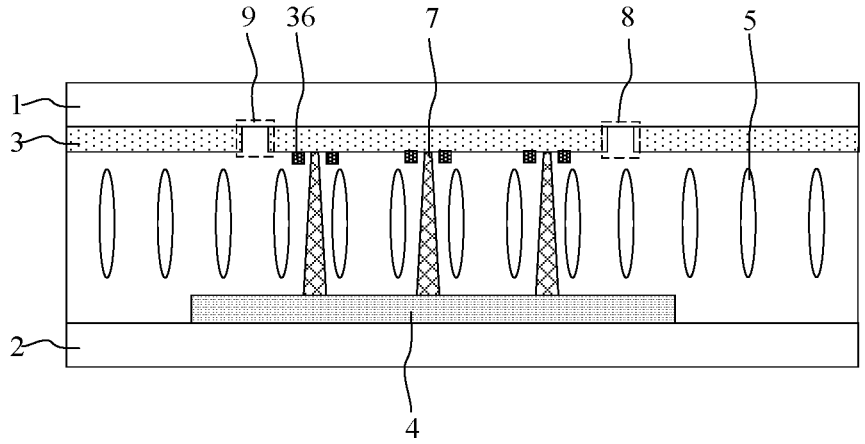
FIG. 16 is a schematic diagram of a limiting portion provided by an embodiment of the present disclosure.

FIG. 16 is a schematic diagram of a limiting portion provided by an embodiment of the present disclosure. In an embodiment, as shown in FIG. 16, a limiting portion 36 is provided on the first substrate 1 and provided on a side of the first electrode 3 facing towards the second substrate 2, and the limiting portion 36 surrounds the first spacer 7 and is configured to limit the first spacer 7. When the phase shifter is compressed by an external force, the first spacer 7 is limited by the limiting portion 36, which can prevent the first spacer 7 from sliding into the first opening 8 or the second opening 9 of the first electrode 3 under the external force, thereby avoiding affecting the coupling of the radio frequency signal.

Figure 17:
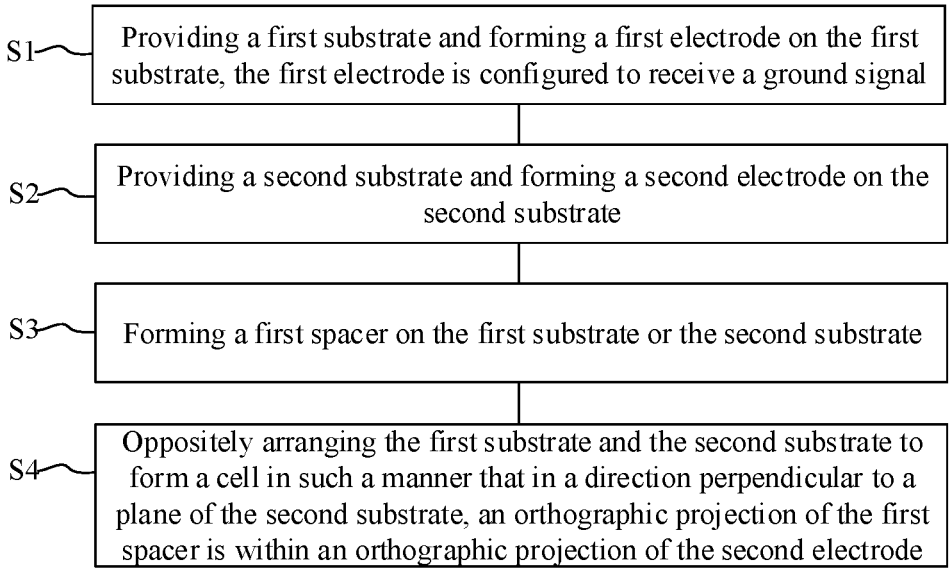
FIG. 17 is a flowchart of a manufacturing method of a phase shifter according to an embodiment of the present disclosure.

With reference to FIG. 1 to FIG. 3, an embodiment of the present disclosure provides a manufacturing method of the phase shifter. FIG. 17 is a flowchart of a manufacturing method of a phase shifter provided by an embodiment of the present disclosure. As shown in FIG. 17, the methods include the following steps.

At step S1, the first substrate 1 is provided, and the first electrode 3 configured to receive a ground signal is formed on the first substrate 1. In an embodiment, the first electrode 3 can be electrically connected to the ground terminal of the flexible circuit board or the ground signal source, and is configured to receive the ground signal provided by the flexible circuit board or the ground signal provided by the ground signal source.

At step S2, the second substrate 2 is provided, and the second electrode 4 is formed on the second substrate 2. The second electrode 4 can be passively driven or actively driven.

At step S3, the first spacer 7 is formed on the first substrate 1 or the second substrate 2.

At step S4, the first substrate 1 and the second substrate 2 are oppositely arranged to form a cell in such a manner that in the direction perpendicular to the plane of the second substrate 2, the orthographic projection of the first spacer 7 is located within the orthographic projection of the second electrode 4.

With the manufacturing method provided by the present disclosure, the first spacer 7 is provided on the second electrode 4, so that the first spacer 7 can stably support the cell gap located in the region where the second electrode 4 is located, thereby effectively improving the uniformity of the cell gap located in the region where the electrode 4 is located, reducing the difference in the filling volumes of the liquid crystals 5 located at different positions of the region, optimizing the phase shift effect of the radio frequency signal, and improving the accuracy of the radiating angle of the radio frequency signal radiated by the phase shifter.

Moreover, even when the phase shifter is compressed due to external extrusion force, low temperature environment or other factors, the compression degree of this area can be significantly reduced due to the support of the first spacer 7, thereby avoiding a large difference of the cell gap located in this region.

In an embodiment, with reference to FIG. 5 and FIG. 6, after forming the second electrode 4 on the second substrate 2, the manufacturing method further includes: forming an elevating layer 11 on the second substrate 2 in such a manner that in the direction perpendicular to the plane of the second substrate 2, the orthographic projection of the elevating layer 11 and the orthographic projection of the second electrode 4 do not overlap with each other; and forming the second spacer 12 on the first substrate 1 or the second substrate 2. In addition, after the first substrate 1 and the second substrate 2 are oppositely arranged to form a cell, in the direction perpendicular to the plane of the second substrate 2, the orthographic projection of the second spacer 12 is within the orthographic projection of the elevating layer 11.

With the configuration in which the elevating layer 11 and the second spacer 12 are arranged in the region outside the second electrode 4, the second spacer 12 is elevated by the elevating layer 11, so that the height of the elevated second spacer 12 is approaching the height of the first spacer 7 provided on the second electrode 4, and the second spacer 12 can stably support the peripheral region outside the second electrode 4 to improve the uniformity of the cell gap in entire region of the phase shifter.

An embodiment of the present disclosure also provides an antenna. FIG. 18 is a top view of the antenna provided by the embodiment of the present disclosure, and FIG. 19 is a partial cross-sectional view of the antenna provided by the embodiment of the present disclosure. As shown in FIG. 18 and FIG. 19, the antenna includes the above-mentioned phase shifter 100, a feeder portion 200, and a radiator 300. The feeder portion 200 is arranged on the first substrate 1 of the phase shifter, and the feeder portion 200 is connected to a radio frequency signal source 700 through the power division network 400 and configured to receive the radio frequency signal from the signal source 700. The radiator 300 is arranged on the first substrate 1 and configured to radiate the phase-shifted radio frequency signal.

It should be noted that the schematic diagram of the antenna shown in FIG. 18 is illustrated while taking the second electrode 4 adopting the passive driving mode as an example.

With such configuration, the antenna further includes a flexible circuit board 500 and a driving terminal 600 of the flexible circuit board 500 is electrically connected to the second electrode 4.

With reference to FIG. 18, in order to reduce the differential loss, a cut angle of the power division network 400 (the position indicated by the mark A in the figure) is 45°.

Since the antenna provided by the present disclosure includes the above-mentioned phase shifter 100, the antenna can effectively improve the uniformity of the box thickness in the key region where the phase shift is performed on the radio frequency signal, and can reduce the degree of compression in key region when the phase shifter is compressed due to factors such as external extrusion force or low-temperature environment, which avoids large difference of the cell gap located in this region, thereby effectively improving the accuracy of the radiation angle of the radio frequency signal radiated by the phase shifter and increasing the gain of the antenna.

With continued reference to the FIG. 18 and FIG. 19, the ground electrode of the phase shifter is provided with the first opening 8 and the second opening 9, the feeder portion 200 and the radiator 300 are provided on the side of the ground electrode facing away from the first substrate 1. In the direction perpendicular to the plane of the first substrate 1, the orthographic projection of the feeder portion 200 and the first opening 8 overlap with each other, and the orthographic projection of the radiator 300 and the second opening 9 overlap with each other, so that the radio frequency signal transmitted in the feeder portion 200 is coupled to the second electrode 4 via the first opening 8, and the phase-shifted radio frequency signal transmitted in the second electrode 4 is coupled to the radiator 300 via the second opening 9 and is radiated by the radiator 300.

Figure 20:
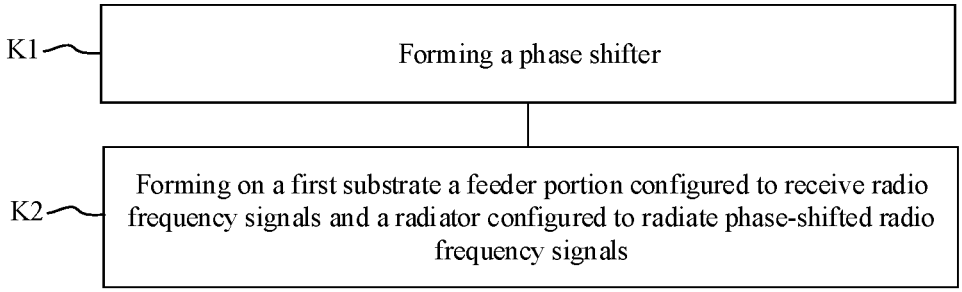
FIG. 20 is a flowchart of a manufacturing method of an antenna provided by an embodiment of the present disclosure.

With reference to FIG. 17 to FIG. 19, an embodiment of the present disclosure provides a manufacturing method of an antenna. FIG. 20 is a flowchart of a manufacturing method of an antenna provided by an embodiment of the present disclosure. As shown in FIG. 20, the manufacturing method includes the following steps.

At step K1, a phase shifter is formed. The steps of forming the phase shifter have been described in the above embodiments and will not be repeated herein.

At step K2, the feeder portion 200 and the radiator 300 for radiating the phase-shifted radio frequency signals are formed on the first substrate 1 of the phase shifter. The feeder portion 200 is connected to the radio frequency signal source 700 through the power division network 400 and is configured to receive the radio frequency signal provided by the radio frequency signal source 700.

With the manufacturing method provided by the present disclosure, the phase shifter is formed, which can improve the uniformity of the cell gap located in the key region where the radio frequency signal is phase-shifted, and reduce the degree of compression in key region when the phase shifter is compressed due to factors such as external extrusion force or low-temperature environment, thereby avoiding large difference of the cell gap located in this region, effectively improving the accuracy of the radiation angle of the radio frequency signal radiated by the phase shifter and increasing the gain of the antenna.

With reference to FIG. 18 and FIG. 19, on the basis of the ground electrode of the phase shifter being provided with a first opening 8 and a second opening 9, the forming the feeder 200 and the radiator 300 on the first substrate 1 of the phase shifter includes: forming the feeder portion 200 and the radiator 300 on a side of the ground electrode facing away from the first substrate 1 in such a manner that in a direction perpendicular to the plane of the first substrate 1, the orthographic projection of the feeder portion 200 and the first opening 8 overlap with each other and the orthographic projection of the radiator 300 and the second opening 9 overlap with each other, so that the radio frequency signal transmitted in the feeder portion 200 is coupled to the second electrode 4 via the first opening 8, and the phase-shifted radio frequency signal transmitted in the second electrode 4 is coupled to the radiator 300 via the second opening 9 and radiated out by the radiator 300, thereby ensuring that the antenna can radiate beam normally.

The embodiments described above are embodiments of the present disclosure, but not intended to limit the present disclosure. Any modifications, equivalent substitutions, improvements, etc., which are made within the spirit and principles of the present disclosure, should fall into the protection scope of the present disclosure.

It should be noted that the above embodiments are only used to illustrate the technical solutions of the present disclosure, but not to limit them. Although the present disclosure has been described in detail with reference to the foregoing embodiments, those of ordinary skill in the art should understand that modification can be made to the technical solutions described in the foregoing embodiments, or equivalent replacement can be made to some or all of the technical features thereof. These modifications or replacements do not make the essence of the corresponding technical solutions deviate from the scope of the technical solutions provided by the embodiments of the present disclosure.

What is claimed is:

1. A phase shifter, comprising:

a first substrate and a second substrate that are opposite to each other;

a first electrode provided on the first substrate and being configured to receive a ground signal;

a second electrode provided on a side of the second substrate facing towards the first substrate;

liquid crystals encapsulated between the first substrate and the second substrate and being configured to rotate under driving by the first electrode and the second electrode;

a support structure provided between the first substrate and the second substrate and comprising at least one first spacer, wherein the at least one first spacer is located on a side of the second electrode facing away from the second substrate, and an orthographic projection of each of the at least one first spacer on the second substrate is within an orthographic projection of the second electrode on the second substrate, wherein the first electrode is provided with a first opening and a second opening that are configured to couple radio frequency signals, and the second electrode comprises a primary electrode, a first coupling electrode and a second coupling electrode that are connect to each other, and wherein, in a direction perpendicular to a plane of the first substrate, an orthographic projection of the first coupling electrode overlap the first opening and an orthographic projection of the second coupling electrode overlap the second opening.

2. The phase shifter according to claim 1, wherein each of the at least one first spacer is made of an inorganic material.

3. The phase shifter according to claim 1, wherein the first electrode is provided with a first opening and a second opening that are configured to couple radio frequency signals; and in a direction perpendicular to a plane of the first substrate, the orthographic projection of each of the at least one first spacer does not overlap with the first opening or the second opening.

4. The phase shifter according to claim 1, wherein the supporting structure further comprises a third spacer, wherein in a direction perpendicular to a plane of the second substrate, an orthographic projection of the third spacer does not overlap an orthographic projection of the second electrode, and a height of the third spacer is greater than a height of each of the at least one first spacer.

5. The phase shifter according to claim 1, wherein the at least one first spacer comprises a plurality of first sub-spacers arranged along a first direction, and each of the plurality of first sub-spacers extends along a second direction, and the first direction intersects with the second direction.

6. The phase shifter according to claim 1, wherein the at least one first spacer comprises a central spacer and a plurality of edge spacers surrounding the central spacer.

7. The phase shifter according to claim 6, wherein the plurality of primary spacers is evenly arranged at equal intervals.

8. The phase shifter according to claim 1, wherein the at least one first spacer comprises a primary spacer and an auxiliary spacer, and in a direction perpendicular to a plane of the second substrate, the primary spacer has a height greater than the auxiliary spacer.

9. The phase shifter according to claim 1, wherein each of the at least one first spacer comprises a first support part provided on the first substrate and a second support part provided on the second substrate, and in a direction perpendicular to a plane of the second substrate, the first support part and the second support part overlap with each other.

10. The phase shifter according to claim 1, wherein the primary electrode is a serpentine electrode, a strip-shaped electrode or a comb-shaped electrode.

11. The phase shifter according to claim 1, further comprising:

a first alignment layer provided on a side of the first electrode facing towards the second substrate;

a second alignment layer provided on a side of the second electrode facing towards the first substrate;

a first inorganic protective layer provided between the first alignment layer and the first electrode; and a second inorganic protective layer provided between the second alignment layer and the second electrode.

12. The phase shifter according to claim 1, further comprising:

an elevating layer provided on the side of the second substrate facing towards the first substrate, wherein in a direction perpendicular to a plane of the second substrate, an orthographic projection of the elevating layer does not overlap with an orthographic projection of the second electrode; and the support structure further comprises at least one second spacer provided on a side of the elevating layer facing away from the second substrate, and in the direction perpendicular to the plane of the second substrate, an orthographic projection of each of the at least one second spacer is within the orthographic projection of the elevating layer.

13. The phase shifter according to claim 12, wherein a cavity directly facing the first substrate and the second substrate is formed between the first substrate and the second substrate, and wherein the cavity includes a phase shift region and an encapsulation region surrounding the phase shift region; and wherein in the direction perpendicular to the plane of the second substrate, the orthographic projection of the elevating layer and the orthographic projection of the second electrode together cover an entirety of the phase shift region and a surface of the elevating layer facing away from the second substrate is a flat surface.

14. The phase shifter according to claim 12, wherein each of the at least one first spacer comprises a first top surface and a first bottom surface that are opposite to each other, and the elevating layer comprises a second top surface and a second bottom surface that are opposite to each other, wherein the first bottom surface is closer to the second substrate than the first top surface, and the second bottom surface is closer to the second substrate than the second top surface, and a distance between the second top surface and the second substrate is L1, a distance between the first bottom surface and the second substrate is L2, and L1=L2.

15. The phase shifter according to claim 12, wherein the elevating layer is made of an optical adhesive material.

16. The phase shifter according to claim 12, wherein the at least one first spacer comprises a plurality of first spacers, and the at least one second spacer comprises a plurality of second spacers, and in a unit area, a distribution density of the plurality of first spacers is greater than a distribution density of the plurality of second spacers.

17. The phase shifter according to claim 12, wherein an area of an orthographic projection of a single one of the plurality of first spacers on the second substrate is greater than an area of a single one of the plurality of second spacers on the second substrate.

18. A method for manufacturing a phase shifter, comprising:

providing a first substrate and forming a first electrode on the first substrate, the first electrode being configured to receive a ground signal;

providing a second substrate and forming a second electrode on the second substrate;

forming a first spacer on the first substrate or the second substrate; and oppositely arranging the first substrate and the second substrate to form a cell in such a manner that in a direction perpendicular to a plane of the second substrate, an orthographic projection of the first spacer is within an orthographic projection of the second electrode, wherein the phase shifter comprises:

a first substrate and a second substrate that are opposite to each other;

a first electrode provided on the first substrate and being configured to receive a ground signal;

a second electrode provided on a side of the second substrate facing towards the first substrate;

liquid crystals encapsulated between the first substrate and the second substrate and being configured to rotate under driving by the first electrode and the second electrode;

a support structure provided between the first substrate and the second substrate and comprising at least one first spacer, wherein the at least one first spacer is located on a side of the second electrode facing away from the second substrate, and an orthographic projection of each of the at least one first spacer on the second substrate is within an orthographic projection of the second electrode on the second substrate, wherein the first electrode is provided with a first opening and a second opening that are configured to couple radio frequency signals, and the second electrode comprises a primary electrode, a first coupling electrode and a second coupling electrode that are connect to each other, and wherein, in a direction perpendicular to a plane of the first substrate, an orthographic projection of the first coupling electrode overlap the first opening and an orthographic projection of the second coupling electrode overlap the second opening.

19. The method according to claim 18, further comprising, subsequent to forming the second electrode on the second substrate:

forming an elevating layer on the second substrate in such a manner that in the direction perpendicular to the plane of the second substrate, an orthographic projection of the elevating layer does not overlap the orthographic projection of the second electrode; and forming a second spacer on the first substrate or the second substrate, wherein after the first substrate and the second substrate are oppositely arranged to form a cell, in the direction perpendicular to the plane of the second substrate, an orthographic projection of the second spacer is within the orthographic projection of the elevating layer.

20. An antenna, comprising:

a phase shifter, the phase shifter comprising:

a first substrate and a second substrate that are opposite to each other;

a first electrode provided on the first substrate and being configured to receive a ground signal;

a second electrode provided on a side of the second substrate facing towards the first substrate;

liquid crystals encapsulated between the first substrate and the second substrate and being configured to rotate under driving by the first electrode and the second electrode;

a support structure provided between the first substrate and the second substrate and comprising at least one first spacer, wherein the at least one first spacer is located on a side of the second electrode facing away from the second substrate, and an orthographic projection of each of the at least one first spacer on the second substrate is within an orthographic projection of the second electrode on the second substrate; and wherein the first electrode is provided with a first opening and a second opening that are configured to couple radio frequency signals, and the second electrode comprises a primary electrode, a first coupling electrode and a second coupling electrode that are connect to each other, and wherein, in a direction perpendicular to a plane of the first substrate, an orthographic projection of the first coupling electrode overlap the first opening and an orthographic projection of the second coupling electrode overlap the second opening, a feeder portion provided on the first substrate and configured to receive radio frequency signals; and a radiator arranged on the first substrate and configured to radiate phase-shifted radio frequency signals.

* * * * *